US012698913B2

(12) United States Patent
Moran et al.

(10) Patent No.: US 12,698,913 B2
(45) Date of Patent: Aug. 4, 2026

(54) HVAC SYSTEM MONITORING VIA SENSOR MODULE/ASSEMBLY INCLUDING SENSORS FOR REFRIGERANT DETECTION, PRESSURE, TEMPERATURE, AND HUMIDITY

(71) Applicant: Copeland Comfort Control LP, St. Louis, MO (US)

(72) Inventors: Michael J. Moran, St. Louis, MO (US); John F. Broker, Warrenton, MO (US); Charles P. Ketterer, St. Charles, MO (US)

(73) Assignee: Copeland Comfort Control LP, St. Louis, MO (US)

( * ) Notice: Subject to any disclaimer, the term of this patent is extended or adjusted under 35 U.S.C. 154(b) by 276 days.

(21) Appl. No.: 18/196,348

(22) Filed: May 11, 2023

(65) Prior Publication Data

US 2024/0377087 A1 Nov. 14, 2024

(51) Int. Cl.
*F24F 11/36* (2018.01)
*F24F 11/74* (2018.01)

(52) U.S. Cl.
CPC ..... *F24F 11/36* (2018.01); *F24F 11/74* (2018.01)

(58) Field of Classification Search
CPC .. F24F 11/36; F24F 11/74; F24F 11/39; F24F 11/30; F24F 11/38; F24F 11/49
See application file for complete search history.

(56) References Cited

U.S. PATENT DOCUMENTS

| | | | | |
|---|---|---|---|---|
| 6,993,414 | B2 | 1/2006 | Shah | |
| 7,574,871 | B2 | 8/2009 | Bloemer et al. | |
| 7,640,077 | B2 | 12/2009 | Shah | |
| 8,544,288 | B2 | 10/2013 | MacDonald | |
| 9,244,471 | B2 | 1/2016 | Watts et al. | |
| 10,598,533 | B2 | 3/2020 | Delgoshaei et al. | |
| 10,801,747 | B2 * | 10/2020 | Benefield | F24F 11/58 |
| 10,948,209 | B2 | 3/2021 | Song et al. | |
| 11,415,470 | B2 | 8/2022 | Delgoshaei et al. | |
| 11,739,964 | B1 * | 8/2023 | Donahue | F24F 11/30 700/276 |
| 2007/0205297 | A1 * | 9/2007 | Finkam | F24F 11/30 236/1 C |
| 2012/0232702 | A1 * | 9/2012 | Vass | G05D 23/1934 700/277 |
| 2013/0260668 | A1 * | 10/2013 | Stakutis | F24F 11/74 454/256 |
| 2018/0238574 | A1 * | 8/2018 | Ky | H01Q 1/2291 |
| 2019/0203968 | A1 * | 7/2019 | Lee | F24F 1/20 |
| 2019/0331358 | A1 * | 10/2019 | Ritmanich | F24F 11/46 |
| 2020/0256577 | A1 * | 8/2020 | Apsangi | G05B 23/0283 |

(Continued)

*Primary Examiner* — Nelson J Nieves
(74) *Attorney, Agent, or Firm* — Harness, Dickey & Pierce, P.L.C.; Anthony G. Fussner

(57) ABSTRACT

Disclosed are exemplary systems and methods for monitoring (e.g., diagnosis of, etc.) HVAC system operation via sensor modules or assemblies that include multiple sensors for pressure, temperature, humidity, and refrigerant detection (e.g., A2L refrigerant, other flammable, low Global Warming Potential (GWP) refrigerant, etc.). In exemplary embodiments, the refrigerant detection, pressure, temperature, and humidity sensors are disposed (e.g., integrated, collocated, incorporated, etc.) within a single housing and usable for monitoring (e.g., diagnosis of, etc.) HVAC system operation.

20 Claims, 6 Drawing Sheets

(56) References Cited

U.S. PATENT DOCUMENTS

| | | | | |
|---|---|---|---|---|
| 2020/0393152 | A1* | 12/2020 | Ramirez | F24F 1/42 |
| 2022/0186969 | A1* | 6/2022 | Mu | F24F 11/75 |
| 2023/0029568 | A1* | 2/2023 | Wang | F24F 11/64 |
| 2023/0116873 | A1* | 4/2023 | Wallace | F24F 11/47<br>700/276 |
| 2023/0129818 | A1* | 4/2023 | Harrington | F24D 19/1084<br>236/10 |
| 2023/0314030 | A1* | 10/2023 | Peterson | F24F 11/63<br>700/276 |
| 2023/0354562 | A1* | 11/2023 | Alanqar | H05K 7/20745 |
| 2024/0241098 | A1* | 7/2024 | Chen | G01N 33/0031 |

* cited by examiner

HVAC SYSTEM MONITORING VIA SENSOR MODULE/ASSEMBLY INCLUDING SENSORS FOR REFRIGERANT DETECTION, PRESSURE, TEMPERATURE, AND HUMIDITY

FIELD

The present disclosure generally relates to monitoring (e.g., diagnosis of, etc.) HVAC system operation via a sensor module/assembly that includes refrigerant detection, pressure, temperature, and humidity sensors.

BACKGROUND

This section provides background information related to the present disclosure which is not necessarily prior art.

Current residential heating, ventilation, and air conditioning (HVAC) systems use 410a refrigerant, which uses environmentally harmful fluorinated gases (F-gases). If exposed to the atmosphere, F-gases have a negative impact to global warming, which is measured in terms of GWP (global warming potential). Accordingly, new regulations will require lower GWP refrigerants. In response, the industry is currently proposing safer refrigerants including R454b and R32 that are classified as mildly flammable.

DRAWINGS

The drawings described herein are for illustrative purposes only of selected embodiments and not all possible implementations, and are not intended to limit the scope of the present disclosure.

Figure 1:
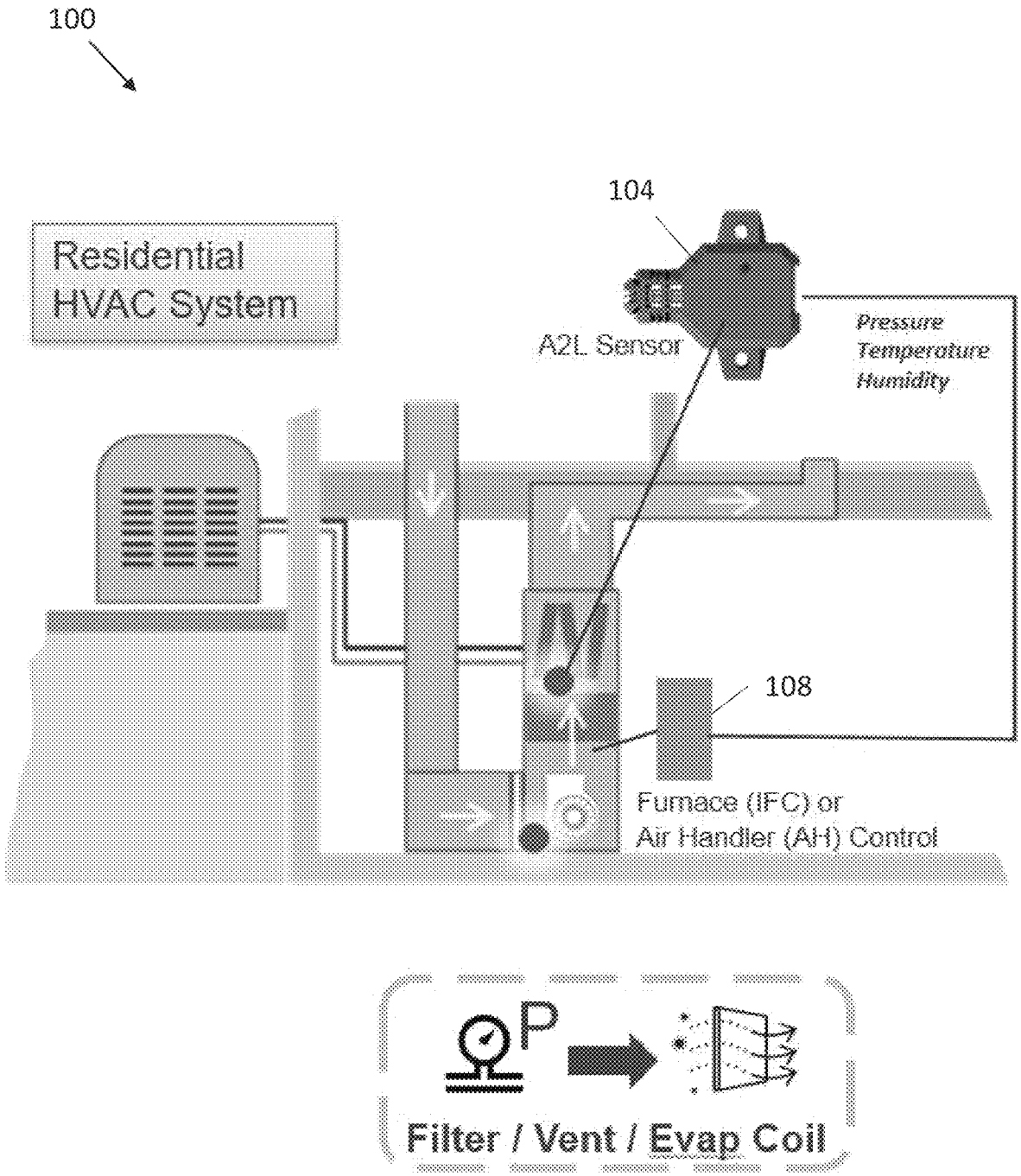

FIG. 1 illustrates a residential HVAC system including a sensor module or assembly according to an exemplary embodiment of the present disclosure in which the sensor module/assembly includes A2L refrigerant detection, pressure, temperature, and humidity sensors disposed (e.g., integrated, collocated, incorporated, etc.) within a single housing. In this exemplary embodiment, static pressure data is obtainable via the sensor module/assembly and usable to determine (e.g., algorithmically, etc.) undesirable pressure changes within the residential ductwork that are indicative of a blockage, e.g., blocked filter, closed vent, evaporator coil freeze up, etc.

Figure 2:
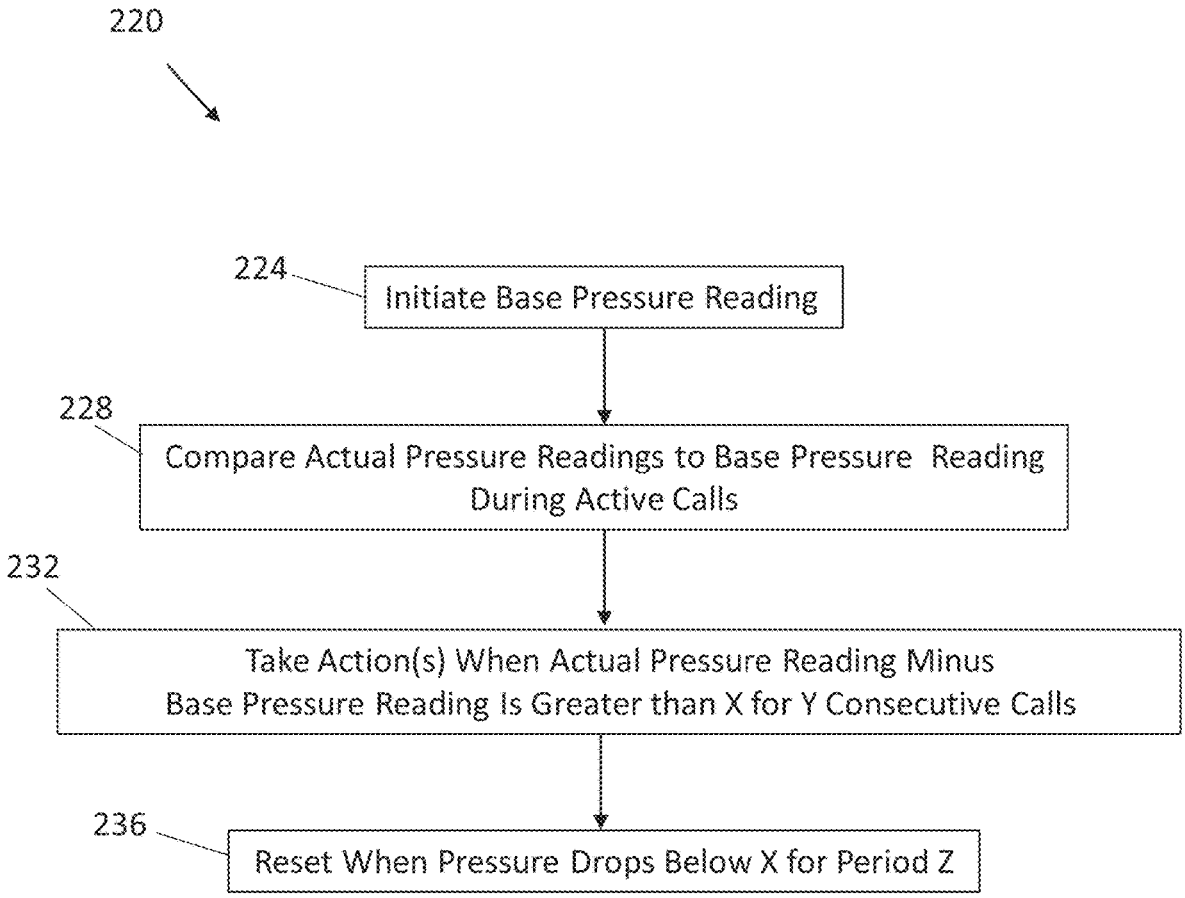

FIG. 2 illustrates an exemplary method for using static pressure data obtained via the sensor module/assembly shown in FIG. 1 to determine undesirable pressure changes indicative of a blockage (e.g., blocked filter, closed vent, evaporator coil freeze up, etc.).

Figure 3:
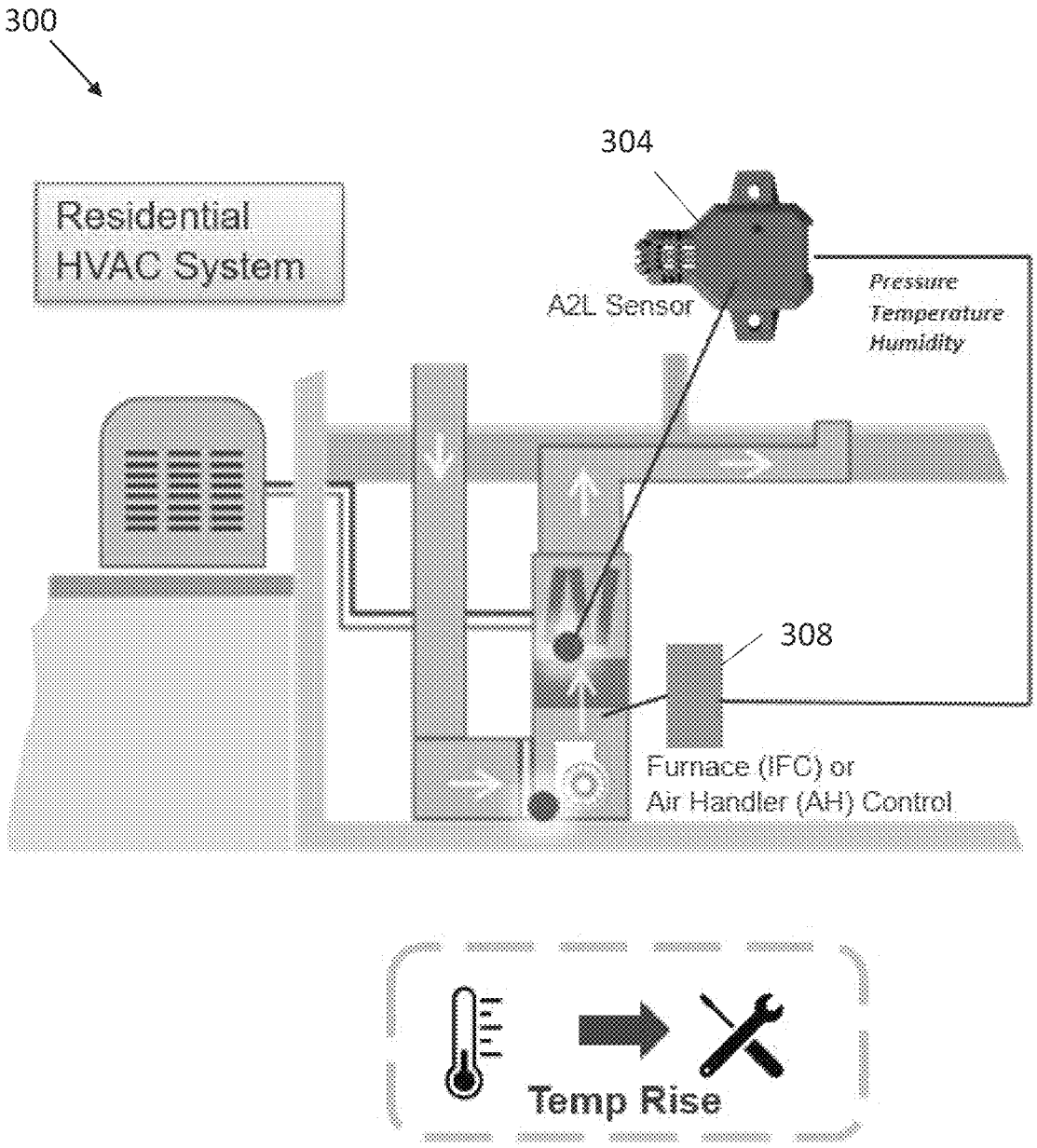

FIG. 3 illustrates a residential HVAC system including a sensor module or assembly according to an exemplary embodiment of the present disclosure in which the sensor module/assembly includes A2L refrigerant detection, pressure, temperature, and humidity sensors disposed (e.g., integrated, collocated, incorporated, etc.) within a single housing. In this exemplary embodiment, temperature data is obtainable via the sensor module/assembly and usable to determine (e.g., algorithmically, etc.) undesirable temperature changes that are indicative of an underperforming HVAC system.

Figure 4:
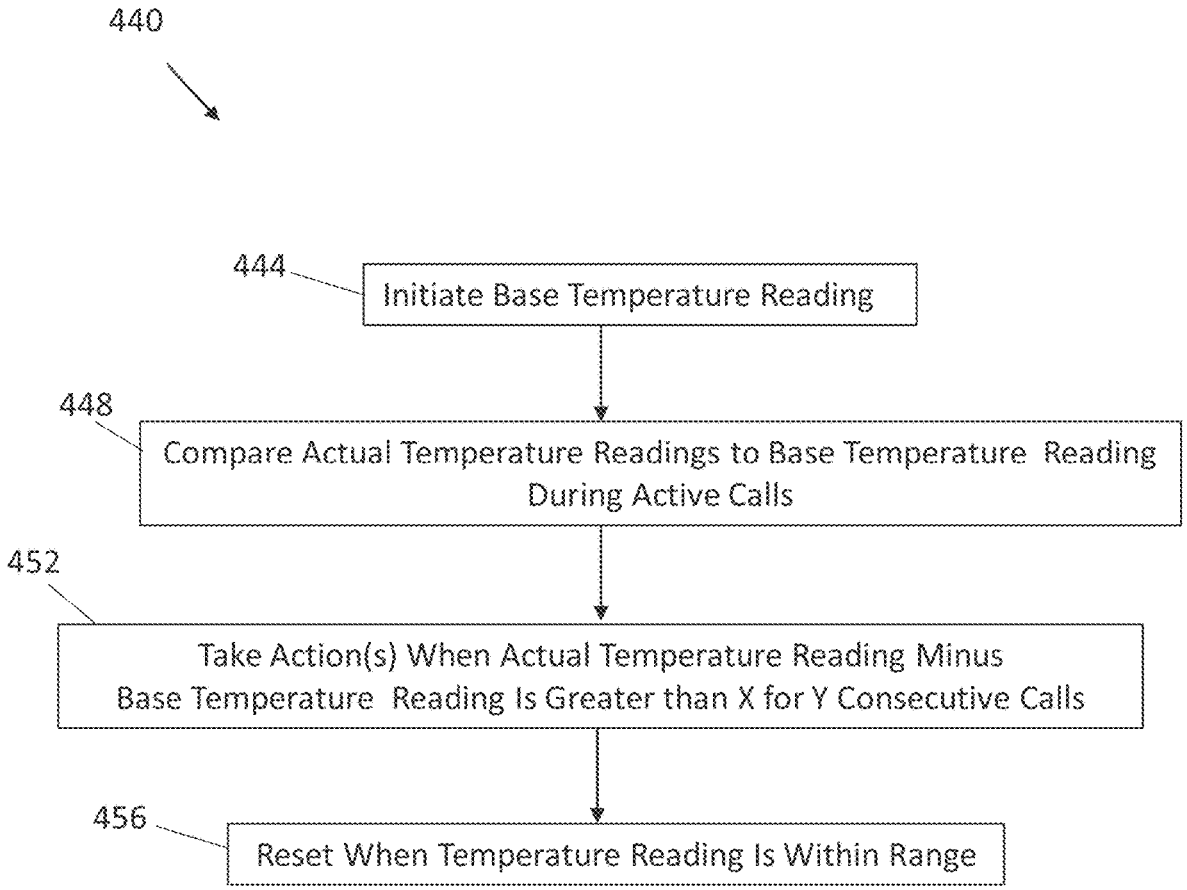

FIG. 4 illustrates an exemplary method for using temperature data obtained via first and second temperature sensors respectively onboard the IFC and the sensor module/assembly shown in FIG. 3 to determine (e.g., algorithmically, etc.) undesirable temperature changes that are indicative of an underperforming HVAC system.

Figure 5:
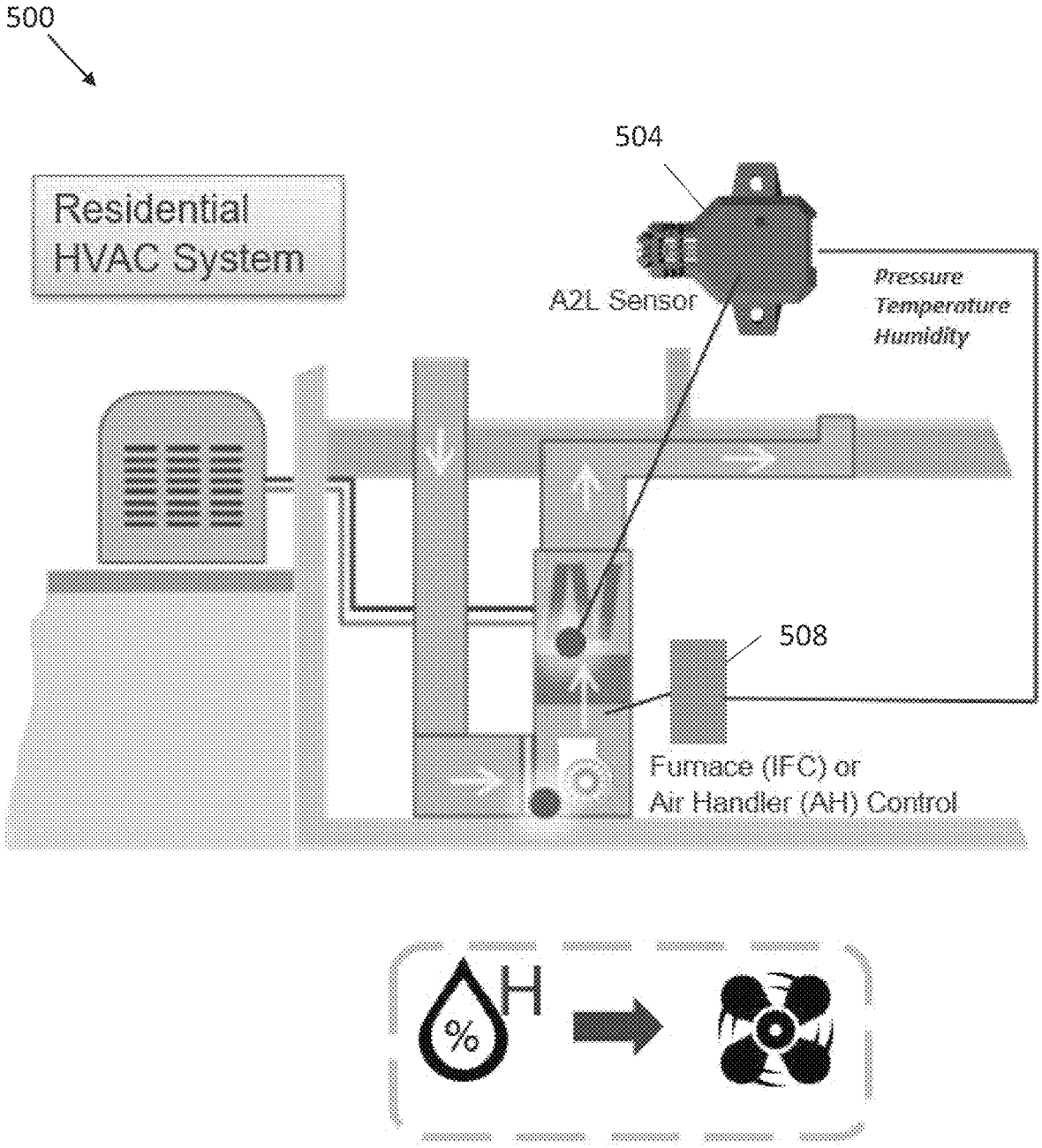

FIG. 5 illustrates a residential HVAC system including a sensor module or assembly according to an exemplary embodiment of the present disclosure in which the sensor module/assembly includes A2L refrigerant detection, pressure, temperature, and humidity sensors disposed (e.g., integrated, collocated, incorporated, etc.) within a single housing. In this exemplary embodiment, humidity data is obtainable via the sensor module/assembly and usable to automatically adjust (e.g., algorithmically, etc.) blower speeds for better home comfort, e.g., using a standard electronically commutated motor (EMC), etc.

Figure 6:
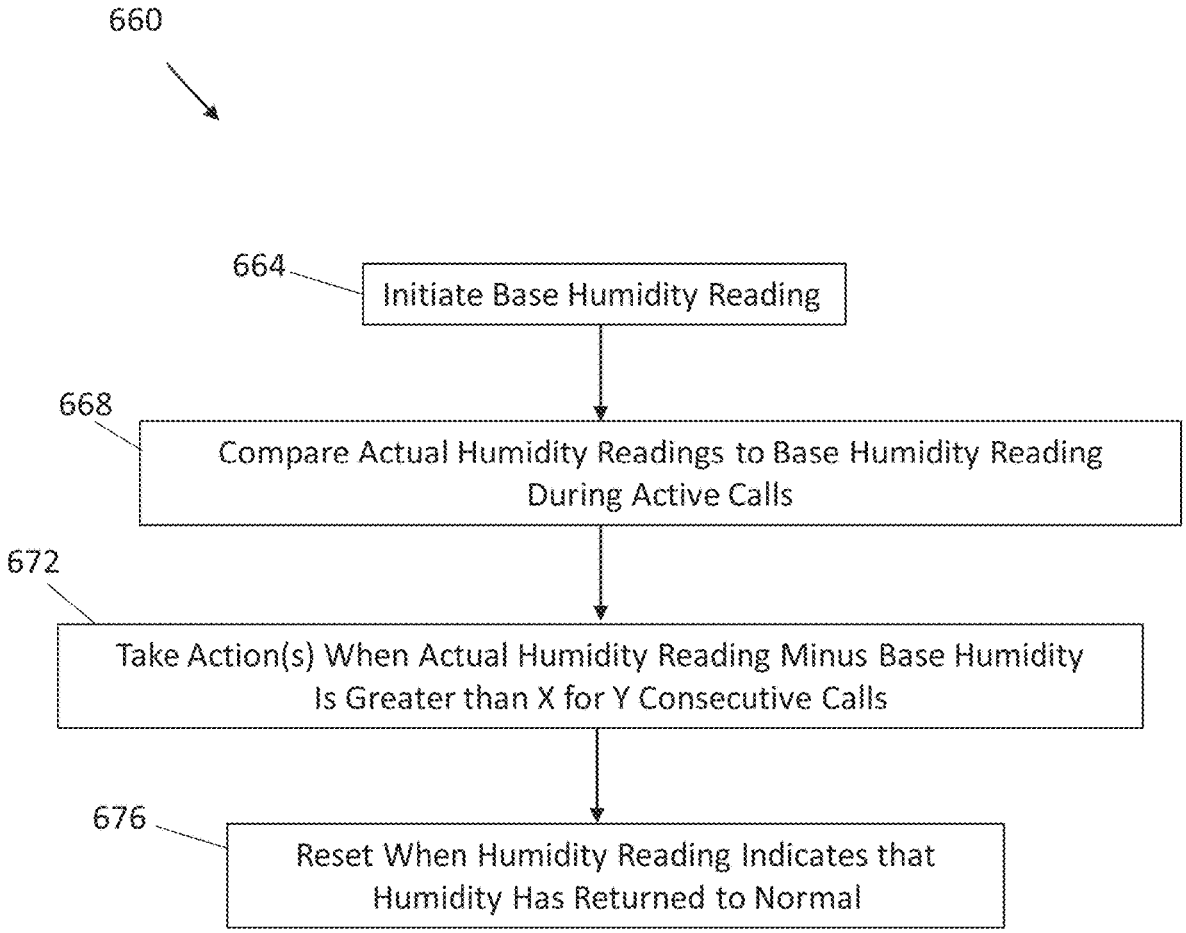

FIG. 6 illustrates an exemplary method for using humidity data obtained via the sensor module/assembly shown in FIG. 5 to automatically adjust (e.g., algorithmically, etc.) blower speeds.

Corresponding reference numerals may indicate corresponding (though not necessarily identical) parts throughout the several views of the drawings.

DETAILED DESCRIPTION

Example embodiments will now be described more fully with reference to the accompanying drawings.

As noted above, new regulations will require lower GWP refrigerants. In response, the industry is currently proposing safer refrigerants including R454b and R32 that are classified as mildly flammable. As recognized herein, the use of such flammable refrigerants will require a mitigation method that is currently not needed in today's systems (for a certain volume of refrigerant).

As further recognized herein, implementing a mitigation method may include using a flammable gas detection sensor that interfaces directly to the HVAC control within a furnace or air handler. The flammable gas detection sensor may include raw sensing elements for humidity, pressure, and temperature, which are needed to accurately detect the presence of combustible gases. The flammable gas detection sensor is preferably located at a position for good A2L functionality, e.g., lower than the evaporator coil (A-coil) as most A2L refrigerants are heavier than air, etc. If the furnace control is mounted in the return air stream (e.g., above a downflow furnace, etc.), then temperatures along both sides of the evaporator coil may be obtained, which is very useful information. This will also be the supply air for humidity, which is a useful place for measuring humidity.

Accordingly, the inventors hereof have recognized herein the benefits of adding pressure, temperature, and/or humidity measurements along either or both sides of the evaporator (A-coil). After recognizing the above, exemplary embodiments were developed and/or are disclosed herein in which raw data (serial, digital, and/or analog data) is monitored from humidity, pressure, and temperature sensing elements (e.g., raw sensing elements included with the flammable gas detection sensor, etc.) to provide additional benefits to the HVAC control. In exemplary embodiments disclosed herein, raw static pressure, temperature, and/or humidity data obtained via raw sensing elements of a refrigerant gas detection sensor may be used for monitoring HVAC system operation, e.g., to improve comfort, to improve quality HVAC installations, and/or to improve diagnostics, etc.

In exemplary embodiments, the system is configured to obtain raw pressure data via a raw pressure sensing element or pressure sensor of the sensor module or assembly, which also includes a refrigerant gas detection sensor. The system is configured to determine (e.g., algorithmically and accurately determine, etc.) undesirable pressure changes within ductwork (e.g., a homeowner's ductwork, residential ductwork, etc.) that negatively impact performance of the HVAC system. This may include, for example, when an HVAC air filter needs to be changed, when vent(s) are closed, when an evaporator coil is freezing up, when the HVAC motor is under performing or has failed, etc.

In exemplary embodiments, the system is configured to obtain raw temperature data via a raw temperature sensing element or temperature sensor of the sensor module or assembly, which also includes a refrigerant gas detection sensor. The system is configured to determine (e.g., algorithmically and accurately determine, etc.) undesirable temperature changes in the furnace or air handler that could detect or predict a poor blower function, poor HVAC performance, poor system charge indication and/or that could provide better diagnostics and/or earlier failure detection. This could also be used in combination with other data including what is expected for the operation of a specific appliance, especially when the appliance's model or installation information is known.

In exemplary embodiments, the system is configured to obtain raw humidity data via a raw humidity sensing element or humidity sensor of the sensor module or assembly, which also includes a refrigerant gas detection sensor. The system is configured to automatically adjust (e.g., algorithmically, etc.) blower speeds to improve overall comfort for the occupant(s) automatically and/or based on setting(s). This can also be used for auto installation, improved installation, and/or better diagnostics.

With reference to the figures, FIG. 1 illustrates an exemplary embodiment of a residential HVAC system 100 including a sensor module or assembly 104 and an integrated furnace control (IFC) or air handler (AH) 108. The sensor module/assembly 104 includes A2L refrigerant detection, pressure, temperature, and humidity sensors disposed (e.g., integrated, collocated, incorporated, etc.) within a single housing. In this example, static pressure data is obtained via the sensor module/assembly 104 and used (e.g., input to the integrated furnace control (IFC) or air handler (AH) 108, etc.) to determine (e.g., algorithmically, etc.) undesirable pressure changes within the residential ductwork that are indicative of a blockage, e.g., blocked filter, closed vent, evaporator coil freeze up, etc.

Analyzing the pressure and the rate of change of pressure enables early detection (e.g., an indicator(s) or condition(s) indicating, etc.) that an evaporator is freezing up before the evaporator completely freezes up. With this early detection that the evaporator is in the process of freezing up, remedial action(s) (e.g., increasing airflow, turning compressor off, etc.) may then be undertaken to prevent the complete evaporator freeze up. For example, evaporator coils may freeze if there is insufficient airflow caused by a clogged or dirty air filter, dirty coils, backed-up or clogged drain, and/or low fan speed. In response to the early detection of the evaporator freezing up before a complete evaporator freeze up, a dirty air filer may be replaced, evaporator coils may be cleaned, a clogged drain may unclogged, fan speed may be increased, and/or other remedial action(s) may be undertaken to prevent the evaporator from completely freezing up.

FIG. 2 illustrates an exemplary method 220 for using static pressure data obtained via the sensor module/assembly 104 (FIG. 1) to determine undesirable pressure changes indicative of a blockage (e.g., blocked filter, closed vent, evaporator coil freeze up, etc.). In this exemplary method, an installer initiates a base pressure reading (e.g., a desired pressure, etc.) at 224, e.g., via an app on a portable electronic device (e.g., smartphone, tablet, etc.), a control interface, or other method. At 228, actual pressure readings are compared (e.g., via an algorithm, etc.) to the base pressure reading initiated at 224 during all active calls. At 232, an alarm is generated (e.g., visually displayed alert, audible alarm, etc.) and/or other action(s) are taken when it is determined that the pressure delta or difference between the actual pressure reading minus the base pressure reading is greater than a predetermined value (X) for a predetermined number (Y) of consecutive calls. At 236, the code is reset (e.g., automatically or manually) when the actual pressure sufficiently drops such that the difference between the actual pressure reading minus the base pressure reading is less than the predetermined value (X) for a predetermined time period (Z) or other variations (e.g., variations within the algorithm, etc.). In this exemplary method, an alarm code may be a visual indication of an issue that needs to be addressed (e.g., possibly a filter needs to be changed). And the reset code is the condition that an issue is not present, such that the code may then be automatically or manually reset.

In a base pressure reading example, the supply static reading is positive (+) 0.25 inches water column, the return static pressure reading is negative (−) 0.25 inches water column, and the total system static pressure is 0.5 inches water column. By way of further example, the predetermined value (X) may be 0.7 inches water column, the predetermined number (Y) of consecutive calls may be 5 active calls, and the predetermined time period (Z) may be 1 minute.

FIG. 3 illustrates an exemplary embodiment of a residential HVAC system 300 including a sensor module or assembly 304 and an integrated furnace control (IFC) or air handler (AH) 308. The sensor module/assembly 304 includes A2L refrigerant detection, pressure, temperature, and humidity sensors disposed (e.g., integrated, collocated, incorporated, etc.) within a single housing. In this example, temperature data is obtained via the sensor module/assembly 304 and used (e.g., input to the integrated furnace control (IFC) or air handler (AH) 308, etc.) to determine (e.g., algorithmically, etc.) undesirable temperature changes that are indicative of an underperforming HVAC system.

The integrated furnace control (IFC) or air handler (AH) 308 may comprise an integrated furnace control (IFC) that includes a first temperature sensor onboard the IFC. When the IFC (and its onboard first temperature sensor) is mounted in the airflow as shown in FIG. 3, temperature in the airflow can be known via the IFC's onboard temperature sensor. The sensor module/assembly 304 (including its A2L refrigerant sensor, pressure sensor, second temperature sensor, and humidity sensor) may be disposed along or mounted on a second side of the evaporator coil (A-coil) opposite the first side of the evaporator coil along which the IFC (and its onboard first temperature sensor) are disposed. In which case, temperatures along both the first and second opposite sides of the evaporator coil may be respectively obtained via the IFC's onboard first temperature sensor along the first side of the evaporator coil and the second temperature sensor of the sensor module/assembly 304 along the second side of the evaporator coil.

FIG. 4 illustrates an exemplary method 440 for using temperature data obtained via the IFC's onboard first temperature sensor and the second temperature sensor of the sensor module/assembly 304 to determine (e.g., algorithmically, etc.) undesirable temperature changes that are indicative of an underperforming HVAC system. In this exemplary method 440, an installer initiates a base temperature reading (e.g., a desired temperature, etc.) at 444, e.g., via an app on a portable electronic device (e.g., smartphone, tablet, etc.), a control interface, or other method. At 448, actual temperature readings are compared (e.g., via an algorithm, etc.) to the base temperature reading initiated at 444 during all active calls. At 452, an alarm is generated (e.g., visually displayed alert, audible alarm, etc.) and/or other action(s) are taken when it is determined the temperature delta or difference between the actual temperature readings minus the base temperature reading is greater than a predetermined value (X) for a predetermined number (Y) of consecutive calls. At 456, the code is reset (e.g., automatically or manually) when the actual temperature readings are within an acceptable range (e.g., temperature delta between the actual temperature readings minus the base temperature reading is less than the predetermined value (X) for a predetermined time period (Z), other variations within the algorithm, etc.). In this exemplary method, an alarm code may be a visual indication of an issue that needs to be addressed (e.g., possibly a filter needs to be changed). And the reset code is the condition that an issue is not present, such that the code may then be automatically or manually reset.

By way of example, the base temperature reading may be 500 degrees Fahrenheit, the predetermined value (X) may be 600 degrees Fahrenheit, the predetermined number (Y) of consecutive calls may be 5 active calls, and the predetermined time period (Z) may be 1 minute.

FIG. 5 illustrates an exemplary embodiment of a residential HVAC system 500 including a sensor module or assembly 504 and an integrated furnace control (IFC) or air handler (AH) 508. The sensor module/assembly 504 includes A2L refrigerant detection, pressure, temperature, and humidity sensors disposed (e.g., integrated, collocated, incorporated, etc.) within a single housing. In this example, humidity data is obtained via the sensor module/assembly 504 and used (e.g., input to the integrated furnace control (IFC) or air handler (AH) 508, etc.) to automatically adjust (e.g., algorithmically, etc.) blower speeds for better home comfort, e.g., using a standard electronically commutated motor (EMC), etc.

FIG. 6 illustrates an exemplary method 660 for using humidity data obtained via the sensor module/assembly 504 (FIG. 5) to automatically adjust (e.g., algorithmically, etc.) blower speeds. In this exemplary method 660, an installer initiates a base humidity reading (e.g., a desired humidity, etc.) at 664, e.g., via an app on a portable electronic device (e.g., smartphone, tablet, etc.), a control interface, or other method. At 668, actual humidity readings are compared (e.g., via an algorithm, etc.) to the base humidity reading initiated at 664 during all active calls. At 672, an action(s) are taken when it is determined that the humidity delta or difference between the actual humidity reading minus the base humidity reading is greater than a predetermined value (X) for a predetermined number (Y) of consecutive calls. For example, the blower speed may be decreased at 672 by automatically lowering blower speed tap, e.g., by increments of one, etc. At 676, the blower speed is reset to the original speed tap after the actual humidity reading indicates that humidity has returned to normal. By way of example, the predetermined value (X) may be 55 percent (%), and the predetermined number (Y) of consecutive calls may be 5 active calls.

Exemplary methods disclosed herein may provide occupant(s) (e.g., homeowner(s), residential occupant(s), other occupant(s) in a conditioned space, etc.) with additional benefits in environments that either have higher than normal humidity or incorrect blower tap settings for the application. In a cooling example, actual humidity may be higher than desired such that it is preferable to have the system (e.g., using a standard 5 tap (or greater) ECM blower, etc.) to automatically adjust the blower speed down 1 setting to increase the system run time thereby reducing the humidity in the conditioned space. In this example, additional feedback of temperature and pressure (e.g., obtained via the sensor module/assembly 104 (FIG. 1), 304 (FIG. 3), 504 (FIG. 5), etc.) may be needed (e.g., by the algorithm, etc.) to help determine the lower threshold for when an evaporator coil could be freezing over.

Exemplary embodiments are disclosed of systems for monitoring HVAC system operation. In exemplary embodiments, a system comprises a sensor module including a refrigerant detection sensor, a pressure sensor, a temperature sensor, and a humidity sensor that are integrated and/or incorporated within the sensor module. The system is configured to be operable for: (A) monitoring static pressure data obtained via the pressure sensor of the sensor module for pressure change(s) indicative of a blockage; and/or (B) monitoring temperature data obtained via the temperature sensor of the sensor module for temperature change(s) indicative of an underperforming HVAC system; and/or (C) monitoring humidity data obtained via the humidity sensor of the sensor module for a humidity reading above a humidity threshold.

In exemplary embodiments, the system is configured to be operable for using the refrigerant detection sensor of the sensor module for monitoring for a presence of refrigerant indicative of a refrigerant leak.

In exemplary embodiments, the system is configured to be operable for using the same sensor module for: monitoring, via the refrigerant sensor of the sensor module, for a presence of refrigerant indicative of a refrigerant leak; and monitoring static pressure data obtained via the pressure sensor of the sensor module for pressure change(s) indicative of a blockage; and monitoring temperature data obtained via the temperature sensor of the sensor module for temperature change(s) indicative of an underperforming HVAC system; and monitoring humidity data obtained via the humidity sensor of the sensor module for a humidity reading above a humidity threshold.

In exemplary embodiments, the refrigerant detection sensor, the pressure sensor, the temperature sensor, and the humidity sensor are collocated within and/or under a single housing of the sensor module.

In exemplary embodiments, the refrigerant detection sensor of the sensor module is configured to be operable for detecting a presence of A2L refrigerant.

In exemplary embodiments, the system is configured to be operable for algorithmically determining, from the static pressure data obtained via the pressure sensor of the sensor module, pressure change(s) within ductwork of the HVAC system indicative of a blockage, such as a blocked or clogged condition of a filter, a closed vent, and/or an evaporator coil freeze up.

In exemplary embodiments, the system is configured to be operable for monitoring the temperature data obtained via the temperature sensor of the sensor module and temperature data obtained via a temperature sensor onboard an integrated furnace control (IFC) of the HVAC system for temperature change(s) indicative of an underperforming HVAC system. In such exemplary embodiments, the HVAC system may include an evaporator coil having first and second opposite sides. The temperature sensor onboard the integrated furnace control (IFC) may be along the first side of the evaporator coil. The temperature sensor of the sensor module may be along the second side of the evaporator coil. And temperature data along the first and second opposite sides of the evaporator coil may be respectively obtainable via the IFC's onboard temperature sensor along the first side of the evaporator coil and the sensor module's temperature sensor along the second side of the evaporator coil. In addition, the system may be configured to be operable for algorithmically determining, from the temperature data obtained via the temperature sensor of the sensor module and the temperature sensor onboard the integrated furnace control, temperature changes indicative of an underperforming HVAC system.

In exemplary embodiments, the system is configured to be operable for automatically adjusting blower speed in response to the system detecting a humidity reading above the humidity threshold.

In exemplary embodiments, the system is configured to be operable for automatically decreasing blower speed in response to algorithmically determining, from the humidity data obtained via the humidity sensor of the sensor module, that humidity is above the humidity threshold. In such exemplary embodiments, the system may be configured to be operable for automatically decreasing blower speed by automatically lowering blower speed tap by increments of one. And the system may be configured to be operable for automatically resetting blower speed to the original tap speed after algorithmically determining, from the humidity data obtained via the humidity sensor of the sensor module, that the humidity is below the humidity threshold.

In exemplary embodiments, the system is configured to be operable for: comparing static pressure data obtained via the pressure sensor of the sensor module to a base pressure value during active calls of the HVAC system; determining whether a pressure delta between the static pressure data minus the base pressure value is greater than a predetermined value (X) for a predetermined number (Y) of consecutive calls; and generating an alert when the system determines that the pressure delta is greater than the predetermined value (X) for the predetermined number (Y) of consecutive calls.

In exemplary embodiments, the system is configured to be operable for: comparing temperature data obtained via the temperature sensor of the sensor module to a base temperature value during active calls of the HVAC system; determining whether a temperature delta between the static temperature data minus the base temperature value is greater than a predetermined value (X) for a predetermined number (Y) of consecutive calls; and generating an alert when the system determines that the temperature delta is greater than the predetermined value (X) for the predetermined number (Y) of consecutive calls.

In exemplary embodiments, the system is configured to be operable for: comparing humidity data obtained via the humidity sensor of the sensor module to a humidity value during active calls of the HVAC system; determining whether a humidity delta between the humidity data minus the base humidity value is greater than a predetermined value (X) for a predetermined number (Y) of consecutive calls; and automatically reducing blower speed when the system determines that the humidity delta is greater than the predetermined value (X) for the predetermined number (Y) of consecutive calls.

In exemplary embodiments, an HVAC system comprises a system as disclosed herein. The HVAC system further comprises an evaporator coil having first and second opposite sides, and an integrated furnace control including a temperature sensor onboard the integrated furnace control. The temperature sensor onboard the integrated furnace control is along the first side of the evaporator coil. The temperature sensor of the sensor module is along the second side of the evaporator coil. Temperature data along the first and second opposite sides of the evaporator coil is respectively obtainable via the temperature sensor onboard the integrated furnace control that is along the first side of the evaporator coil and the temperature sensor of the sensor module that is along the second side of the evaporator coil. And the system is configured to be operable for: monitoring the temperature data obtained via the temperature sensor of the sensor module and temperature data obtained via the temperature sensor onboard the integrated furnace control for temperature change(s) indicative of underperformance of the HVAC system; and monitoring, via the refrigerant sensor of the sensor module, for a presence of refrigerant indicative of a refrigerant leak; and monitoring static pressure data obtained via the pressure sensor of the sensor module for pressure change(s) indicative of a blockage; and monitoring humidity data obtained via the humidity sensor of the sensor module for a humidity reading above a humidity threshold.

Also disclosed are exemplary methods for monitoring HVAC system operation. In exemplary embodiments, the method comprises using a sensor module including a refrigerant detection sensor, a pressure sensor, a temperature sensor, and a humidity sensor that are integrated and/or incorporated within the sensor module. The method includes: (A) monitoring static pressure data obtained via the pressure sensor of the sensor module for pressure change(s) indicative of a blockage; and/or (B) monitoring temperature data obtained via the temperature sensor of the sensor module for temperature change(s) indicative of an underperforming HVAC system; and/or (C) monitoring humidity data obtained via the humidity sensor of the sensor module for a humidity reading above a humidity threshold.

In exemplary embodiments, the method includes using the refrigerant detection sensor of the sensor module for monitoring for a presence of refrigerant indicative of a refrigerant leak.

In exemplary embodiments, the method includes using the same sensor module for: monitoring, via the refrigerant sensor of the sensor module, for a presence of refrigerant indicative of a refrigerant leak; and monitoring static pressure data obtained via the pressure sensor of the sensor module for pressure change(s) indicative of a blockage; and monitoring temperature data obtained via the temperature sensor of the sensor module for temperature change(s) indicative of an underperforming HVAC system; and monitoring humidity data obtained via the humidity sensor of the sensor module for a humidity reading above a humidity threshold.

In exemplary embodiments, the methods includes using the refrigerant detection sensor, the pressure sensor, the temperature sensor, and the humidity sensor that are collocated within and/or under a single housing of the sensor module.

In exemplary embodiments, the methods includes using the refrigerant detection sensor of the sensor module that is configured to be operable for detecting a presence of A2L refrigerant.

In exemplary embodiments, the method includes algorithmically determining, from the static pressure data obtained via the pressure sensor of the sensor module, pressure change(s) within ductwork of the HVAC system indicative of a blockage, such as a blocked or clogged condition of a filter, a closed vent, and/or an evaporator coil freeze up.

In exemplary embodiments, the method includes monitoring the temperature data obtained via the temperature sensor of the sensor module and temperature data obtained via a temperature sensor onboard an integrated furnace control (IFC) of the HVAC system for temperature change (s) indicative of an underperforming HVAC system. In such exemplary embodiments, the HVAC system may include an evaporator coil having first and second opposite sides. The temperature sensor onboard the integrated furnace control (IFC) may be along the first side of the evaporator coil. The temperature sensor of the sensor module may be along the second side of the evaporator coil. And the method include obtaining temperature data along the first and second opposite sides of the evaporator coil respectively via the IFC's onboard temperature sensor along the first side of the evaporator coil and the sensor module's temperature sensor along the second side of the evaporator coil. In addition, the method may include algorithmically determining, from the temperature data obtained via the temperature sensor of the sensor module and the temperature sensor onboard the integrated furnace control, temperature changes indicative of an underperforming HVAC system.

In exemplary embodiments, the method includes automatically adjusting blower speed in response to the system detecting a humidity reading above the humidity threshold.

In exemplary embodiments, the method includes automatically decreasing blower speed in response to algorithmically determining, from the humidity data obtained via the humidity sensor of the sensor module, that humidity is above the humidity threshold. In such exemplary embodiments, the method may include automatically decreasing blower speed by automatically lowering blower speed tap by increments of one. And the method may include automatically resetting blower speed to the original tap speed after algorithmically determining, from the humidity data obtained via the humidity sensor of the sensor module, that the humidity is below the humidity threshold.

In exemplary embodiments, the method includes: comparing static pressure data obtained via the pressure sensor of the sensor module to a base pressure value during active calls of the HVAC system; determining whether a pressure delta between the static pressure data minus the base pressure value is greater than a predetermined value (X) for a predetermined number (Y) of consecutive calls; and generating an alert when the system determines that the pressure delta is greater than the predetermined value (X) for the predetermined number (Y) of consecutive calls.

In exemplary embodiments, the method includes: comparing temperature data obtained via the temperature sensor of the sensor module to a base temperature value during active calls of the HVAC system; determining whether a temperature delta between the static temperature data minus the base temperature value is greater than a predetermined value (X) for a predetermined number (Y) of consecutive calls; and generating an alert when the system determines that the temperature delta is greater than the predetermined value (X) for the predetermined number (Y) of consecutive calls.

In exemplary embodiments, the method includes: comparing humidity data obtained via the humidity sensor of the sensor module to a humidity value during active calls of the HVAC system; determining whether a humidity delta between the humidity data minus the base humidity value is greater than a predetermined value (X) for a predetermined number (Y) of consecutive calls; and automatically reducing blower speed when the system determines that the humidity delta is greater than the predetermined value (X) for the predetermined number (Y) of consecutive calls.

Exemplary embodiments may be implemented in a wide range of production indoor HVAC Gas Furnace and Air Handler controls. Accordingly, aspects of the present disclosure should not be limited to use with any one particular type of system.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for monitoring HVAC system operation, the system comprising a sensor module including a refrigerant detection sensor, a pressure sensor, a temperature sensor, and a humidity sensor that are integrated and/or incorporated within the sensor module, wherein the system is configured to:

(A) monitor static pressure data obtained via the pressure sensor of the sensor module for pressure change(s) indicative of a blockage;

(B) monitor temperature data obtained via the temperature sensor of the sensor module for temperature change(s) indicative of an underperforming HVAC system; and (C) monitor humidity data obtained via the humidity sensor of the sensor module for a humidity reading above a humidity threshold;

wherein the refrigerant detection sensor, the pressure sensor, the temperature sensor, and the humidity sensor are collocated within a same internal space under a single housing of the sensor module.

2. The system of claim 1, wherein the system uses the refrigerant detection sensor of the sensor module to monitor for a presence of refrigerant indicative of a refrigerant leak.

3. The system of claim 1, wherein the system uses the sensor module to:

monitor via the refrigerant sensor of the sensor module, for a presence of refrigerant indicative of a refrigerant leak; and monitor static pressure data obtained via the pressure sensor of the sensor module for pressure change(s) indicative of a blockage; and monitor temperature data obtained via the temperature sensor of the sensor module for temperature change(s) indicative of an underperforming HVAC system; and monitor humidity data obtained via the humidity sensor of the sensor module for a humidity reading above a humidity threshold.

4. The system of claim 1, wherein the system uses the refrigerant detection sensor of the sensor module to detect a presence of A2L refrigerant.

5. The system of claim 1, wherein the system algorithmically determines, from the static pressure data obtained via the pressure sensor of the sensor module, pressure change(s) within ductwork of the HVAC system indicative of a blockage, such as a blocked or clogged condition of a filter, a closed vent, and/or an evaporator coil freeze up.

6. The system of claim 1, wherein the system monitors the temperature data obtained via the temperature sensor of the sensor module and temperature data obtained via a temperature sensor onboard an integrated furnace control (IFC) of the HVAC system for temperature change(s) indicative of an underperforming HVAC system.

7. The system of claim 1, wherein the system automatically adjusts blower speed in response to the system detecting a humidity reading above the humidity threshold.

8. The system of claim 1, wherein the system automatically decreases blower speed in response to algorithmically determining, from the humidity data obtained via the humidity sensor of the sensor module, that humidity is above the humidity threshold.

9. A HVAC system comprising the system of claim 1, an evaporator coil having first and second opposite sides, and an integrated furnace control including a temperature sensor onboard the integrated furnace control, wherein:

the temperature sensor onboard the integrated furnace control is along the first side of the evaporator coil, the temperature sensor of the sensor module is along the second side of the evaporator coil, whereby temperature data along the first and second opposite sides of the evaporator coil is respectively obtainable via the temperature sensor onboard the integrated furnace control that is along the first side of the evaporator coil and the temperature sensor of the sensor module that is along the second side of the evaporator coil; and the system:

monitors the temperature data obtained via the temperature sensor of the sensor module and temperature data obtained via the temperature sensor onboard the integrated furnace control for temperature change(s) indicative of underperformance of the HVAC system; and monitors, via the refrigerant sensor of the sensor module, for a presence of refrigerant indicative of a refrigerant leak; and monitors static pressure data obtained via the pressure sensor of the sensor module for pressure change(s) indicative of a blockage; and monitors humidity data obtained via the humidity sensor of the sensor module for a humidity reading above a humidity threshold.

10. The system of claim 1, wherein:

the sensor module consists of one of each said refrigerant detection sensor, said pressure sensor, said temperature sensor, and said humidity sensor that are integrated and/or incorporated within the same sensor module; and the sensor module obtains each of the following four parameters from a single location at which the sensor module is located:

(A) static pressure data via the only one said pressure sensor of the sensor module;

(B) temperature data via the only one said temperature sensor of the sensor module;

(C) humidity data via the only one said humidity sensor of the sensor module; and (D) detection of a presence of refrigerant indicative of a refrigerant leak via the only one said refrigerant detection sensor.

11. A system for monitoring HVAC system operation, the system comprising a sensor module including a refrigerant detection sensor, a pressure sensor, a temperature sensor, and a humidity sensor that are integrated and/or incorporated within the sensor module, wherein the system is configured to:

(A) monitor static pressure data obtained via the pressure sensor of the sensor module for pressure change(s) indicative of a blockage;

(B) monitor temperature data obtained via the temperature sensor of the sensor module for temperature change(s) indicative of an underperforming HVAC system; and (C) monitor humidity data obtained via the humidity sensor of the sensor module for a humidity reading above a humidity threshold;

wherein:

the system monitors the temperature data obtained via the temperature sensor of the sensor module and temperature data obtained via a temperature sensor onboard an integrated furnace control (IFC) of the HVAC system for temperature change(s) indicative of an underperforming HVAC system;

the HVAC system includes an evaporator coil having first and second opposite sides;

the temperature sensor onboard the integrated furnace control (IFC) is along the first side of the evaporator coil; and the temperature sensor of the sensor module is along the second side of the evaporator coil;

whereby temperature data along the first and second opposite sides of the evaporator coil is respectively obtainable via the IFC's onboard temperature sensor along the first side of the evaporator coil and the sensor module's temperature sensor along the second side of the evaporator coil; and wherein the system algorithmically determines, from the temperature data obtained via the temperature sensor of the sensor module and the temperature sensor onboard the integrated furnace control, temperature changes indicative of an underperforming HVAC system.

12. The system of claim 11, wherein the refrigerant detection sensor, the pressure sensor, the temperature sensor, and the humidity sensor are collocated within a same internal space under a single housing of the sensor module.

13. A system for monitoring HVAC system operation, the system comprising a sensor module including a refrigerant detection sensor, a pressure sensor, a temperature sensor, and a humidity sensor that are integrated and/or incorporated within the sensor module, wherein the system is configured to:

(A) monitor static pressure data obtained via the pressure sensor of the sensor module for pressure change(s) indicative of a blockage;

(B) monitor temperature data obtained via the temperature sensor of the sensor module for temperature change(s) indicative of an underperforming HVAC system; and (C) monitor humidity data obtained via the humidity sensor of the sensor module for a humidity reading above a humidity threshold;

wherein:

the refrigerant detection sensor is a flammable gas detection sensor;

the pressure sensor is a raw pressure sensing element included with the flammable gas detection sensor and configured to obtain raw static pressure data including serial, digital, and/or analog data;

the temperature sensor is a raw temperature sensing element included with the flammable gas detection sensor and configured to obtain raw static temperature data including serial, digital, and/or analog data;

the humidity sensor is a raw humidity sensing element included with the flammable gas detection sensor and configured to obtain raw static humidity data including serial, digital, and/or analog data; and the system:

(A) monitors the raw static pressure data obtained via the raw pressure sensing element included with the flammable gas detection sensor for pressure change (s) indicative of a blockage;

(B) monitors the raw static temperature data obtained via the raw temperature sensing element included with the flammable gas detection sensor for temperature change(s) indicative of an underperforming HVAC system; and (C) monitors the raw static humidity data obtained via the raw humidity sensing element included with the flammable gas detection sensor for a humidity reading above a humidity threshold.

14. A system for monitoring HVAC system operation, the system comprising a sensor module including a refrigerant detection sensor, a pressure sensor, a temperature sensor, and a humidity sensor that are integrated and/or incorporated within the sensor module, wherein the system is configured to:

(A) monitor static pressure data obtained via the pressure sensor of the sensor module for pressure change(s) indicative of a blockage;

(B) monitor temperature data obtained via the temperature sensor of the sensor module for temperature change(s) indicative of an underperforming HVAC system; and (C) monitor humidity data obtained via the humidity sensor of the sensor module for a humidity reading above a humidity threshold;

wherein:

the system automatically decreases blower speed in response to algorithmically determining, from the humidity data obtained via the humidity sensor of the sensor module, that humidity is above the humidity threshold;

the system automatically decreases blower speed by automatically lowering blower speed tap by increments of one; and the system automatically resets blower speed to an original tap speed after algorithmically determining, from the humidity data obtained via the humidity sensor of the sensor module, that the humidity is below the humidity threshold.

15. A system for monitoring HVAC system operation, the system comprising a sensor module including a refrigerant detection sensor, a pressure sensor, a temperature sensor, and a humidity sensor that are integrated and/or incorporated within the sensor module, wherein the system is configured to:

(A) monitor static pressure data obtained via the pressure sensor of the sensor module for pressure change(s) indicative of a blockage;

(B) monitor temperature data obtained via the temperature sensor of the sensor module for temperature change(s) indicative of an underperforming HVAC system; and (C) monitor humidity data obtained via the humidity sensor of the sensor module for a humidity reading above a humidity threshold;

wherein the system:

compares static pressure data obtained via the pressure sensor of the sensor module to a base pressure value during active calls of the HVAC system;

determines whether a pressure delta between the static pressure data minus the base pressure value is greater than a predetermined value (X) for a predetermined number (Y) of consecutive calls; and generates an alert when the system determines that the pressure delta is greater than the predetermined value (X) for the predetermined number (Y) of consecutive calls.

16. The system of claim 15, wherein the system:

compares temperature data obtained via the temperature sensor of the sensor module to a base temperature value during active calls of the HVAC system;

determines whether a temperature delta between the static temperature data minus the base temperature value is greater than a predetermined value (X) for a predetermined number (Y) of consecutive calls; and generates an alert when the system determines that the temperature delta is greater than the predetermined value (X) for the predetermined number (Y) of consecutive calls.

17. The system of claim 16, wherein the system:

compares humidity data obtained via the humidity sensor of the sensor module to a humidity value during active calls of the HVAC system;

determines whether a humidity delta between the humidity data minus the base humidity value is greater than a predetermined value (X) for a predetermined number (Y) of consecutive calls; and automatically reduces blower speed when the system determines that the humidity delta is greater than the predetermined value (X) for the predetermined number (Y) of consecutive calls.

18. A method for monitoring HVAC system operation, the method comprising using a sensor module including a refrigerant detection sensor, a pressure sensor, a temperature sensor, and a humidity sensor that are integrated and/or incorporated within the sensor module, wherein the method includes:

(A) monitoring static pressure data obtained via the pressure sensor of the sensor module for pressure change(s) indicative of a blockage;

(B) monitoring temperature data obtained via the temperature sensor of the sensor module for temperature change(s) indicative of an underperforming HVAC system; and (C) monitoring humidity data obtained via the humidity sensor of the sensor module for a humidity reading above a humidity threshold;

and wherein the method further includes:

comparing static pressure data obtained via the pressure sensor of the sensor module to a base pressure value during active calls of the HVAC system;

determining whether a pressure delta between the static pressure data minus the base pressure value is greater than a predetermined value (X) for a predetermined number (Y) of consecutive calls;

generating an alert when the system determines that the pressure delta is greater than the predetermined value (X) for the predetermined number (Y) of consecutive calls;

comparing temperature data obtained via the temperature sensor of the sensor module to a base temperature value during active calls of the HVAC system;

determining whether a temperature delta between the static temperature data minus the base temperature value is greater than a predetermined value (X) for a predetermined number (Y) of consecutive calls;

generating an alert when the system determines that the temperature delta is greater than the predetermined value (X) for the predetermined number (Y) of consecutive calls, comparing humidity data obtained via the humidity sensor of the sensor module to a humidity value during active calls of the HVAC system;

determining whether a humidity delta between the humidity data minus the base humidity value is greater than a predetermined value (X) for a predetermined number (Y) of consecutive calls; and automatically reducing blower speed when the system determines that the humidity delta is greater than the predetermined value (X) for the predetermined number (Y) of consecutive calls.

19. The method of claim 18, wherein the method includes using the refrigerant detection sensor of the sensor module for monitoring for a presence of refrigerant indicative of a refrigerant leak.

20. The method of claim 18, wherein the method includes monitoring the temperature data obtained via the temperature sensor of the sensor module and temperature data obtained via a temperature sensor onboard an integrated furnace control (IFC) of the HVAC system for temperature change(s) indicative of an underperforming HVAC system.

* * * * *